US005779097A

United States Patent [19]

Olson et al.

[11] Patent Number: 5,779,097

[45] Date of Patent: Jul. 14, 1998

[54] VAPOR RECOVERY SYSTEM WITH INTEGRATED MONITORING UNIT

[75] Inventors: Scott M. Olson, Grand Rapids; Gregory P. Wood; Andrew Chernoby, Jr., both of Kentwood; Roger D. Swieringa, Wyoming, all of Mich.

[73] Assignee: Delaware Capital Formation, Inc., Wilmington, Del.

[21] Appl. No.: 651,338

[22] Filed: May 14, 1996

[51] Int. Cl.[6] ..... B67D 5/16

[52] U.S. Cl. ..... 222/39; 222/71; 222/424; 141/59

[58] Field of Search ..... 222/39, 71, 72, 222/73, 109, 135, 424; 141/59

[56] References Cited

U.S. PATENT DOCUMENTS

| | | | |
|---|---|---|---|
| 2,693,196 | 11/1954 | Hundley | 222/73 X |
| 4,100,758 | 7/1978 | Mayer | 62/54 |
| 4,989,754 | 2/1991 | Grasso et al. | 222/39 |
| 5,360,139 | 11/1994 | Goode | 222/71 X |
| 5,363,988 | 11/1994 | Saxton et al. | 222/72 X |
| 5,450,883 | 9/1995 | Payne et al. | 141/59 |
| 5,484,000 | 1/1996 | Hasselmann | 141/7 |

FOREIGN PATENT DOCUMENTS

| | | |
|---|---|---|
| 0 511 599A1 | 11/1992 | European Pat. Off. . |
| 37 23 943 | 2/1988 | Germany . |
| 42 26 326 | 2/1994 | Germany . |
| 42 26 326A1 | 2/1994 | Germany . |
| WO 93/17955 | 9/1993 | WIPO . |

*Primary Examiner*—Joseph Kaufman

*Attorney, Agent, or Firm*—Flynn, Thiel, Boutell & Tanis, P.C.

[57] ABSTRACT

A vapor recovery system (20) with integrated monitoring unit (28). The system includes one or more tanks (22, 24, 26) into which captured vapor is returned. A pressure sensor (52) is mounted into each tank not in fluid communication with the other tanks. The signals produced by the pressure sensors are forwarded to a control module (54). In the event the measured pressure drops below a selected level the control module actuates an alarm (56). The control module also disables the dispenser (31, 32) generating the liquid that is being vaporized.

26 Claims, 6 Drawing Sheets

DISPENSER
DISPENSER
31
32
54
150a
150b
64a
64b

+5
+12
R
98
102
104
106
108
110
112
114
116
118
120
122
124
126
127
128
129
130
132
134
136
138
140
142
152
154
156

VAPOR RECOVERY SYSTEM WITH INTEGRATED MONITORING UNIT

FIELD OF THE INVENTION

This invention relates generally to vapor recovery systems and, more particularly, to a vapor recovery system with an integrated monitor unit for monitoring the operational state of the vapor recovery system.

BACKGROUND OF THE INVENTION

Vapor recovery systems are employed in many commercial and industrial environments to draw gaseous-state fluids away from a first, source location to a second, destination location. Vapor recovery systems are often found at gasoline stations. At a gasoline station a vapor recovery system is used to recover the vaporized petroleum products that are discharged as an inevitable result of the filling of a vehicle's fuel tank. FIG. 1 schematically shows a vapor recovery system 10 for preventing the loss of volatile, flammable vapor while delivering the fuel (gasoline, kerosene, or alcohol) F to the fill port FP of a powered vehicle PV. The system 10 includes a dispenser D for pumping fuel from a storage tank ST (typically an underground storage tank) through a metering assembly (not shown) into a dualline fuel/vapor hose 12. A hand held trigger T is attached to the end of the hose 12 for controlling the discharge of the fuel F through a nozzle N that is insertable into the vehicle fuel port FP.

Associated with the nozzle N and insertable therewith into the fuel port FP is a vapor pick up, schematically identified as VPU. Vapor pick up VPU connects through a vapor return conduit 13 which extends through the center of hose 12. Vapor return conduit 13 is connected to a vapor recovery pump 11. Vapor recovery pump 11 may be located as shown near the top of the dispenser D or located near ground level adjacent the storage tank ST. Vapor recovery pump 11 draws a vacuum V at vapor pick up VPU so as to draw vapor from the nozzle at the VPU port and return it back to the storage tank ST through return conduit 14. In order to facilitate the return of the vapor back to the storage tank ST, the storage tank is sealed relative to the ambient environment. The system 10 thus supplies fuel from storage tank ST while simultaneously recovering vapors generated during fueling so that the recovered vapors can be returned to the storage tank ST or other storage container. Vapor recovery system 10 thus prevents the release of volatile vapors into the atmosphere. The recovery of these vapors also allows them to be returned to the storage tank ST so that they can be used as fuel. Thus, the vapor recovery system both minimizes pollution and prevents the needless loss of vaporized fuel.

A disadvantage of many vapor recovery systems is that it has been difficult to provide them with monitoring units that evaluate whether or not the vapor recovery equipment is properly functioning. This monitoring is sometimes used to provide an indication to persons tending the vapor recovery system that the system is malfunctioning and requires maintenance. In geographic regions that suffer from poor air quality, environmental regulators may even require the installation of monitoring units integral with vapor recovery systems installed at facilities that would otherwise emit pollution-causing vapors. In some locations, regulatory authorities have proposed connecting the monitoring unit of the vapor recovery system to the vapor-generating equipment. At these locations, if the monitoring unit indicates that the vapor recovery system is malfunctioning, the monitoring unit will then deactivate the vapor-generating equipment.

Despite the obvious desirability of providing a vapor recovery system with a monitoring unit, to date it has been difficult to provide such a unit that is both economical to install and simple to maintain. It has, for example, been proposed to install flow meters in vapor recovery lines 13 to monitor the fluid flow therethrough. In the event the flow meter indicates the fluid flow has ceased, the downstream signal processing equipment will interpret the flow rate state change as an indication of a vapor recovery system malfunction. This type of unit requires flow meters to be installed at or near the inlet port of each vapor recovery pump 11. One disadvantage of this arrangement is that providing individual flow meters for each vapor recovery pump 11 at a multi-pump gasoline station can become quite costly. Still another disadvantage of this type of arrangement is that given the compact space in which most vapor recovery pumps 11 are housed, it may be difficult, if not impossible to find the room needed to install the flow meters. Moreover, flow meters tend to have numerous working components. Over time the components of one or more flow meters may fail which in turn could cause the monitoring unit itself to malfunction.

Still another type of monitoring unit that has been proposed for a vapor recovery system includes a set of gas monitoring sensors. These sensors would be connected to signal processing equipment configured to assert alarm signals in the event the sensed gas indicates the vapor recovery system was malfunctioning and excess volatile vapors are being released into the air. A disadvantage of these units is that it would be difficult to design their signal processing systems so that they only assert the malfunction alarm signals when the vapor recovery systems with which they are associated actually are malfunctioning.

Still other problems are associated with monitoring units designed to be used in conjunction with vapor recovery systems used to recover explosive or flammable vapors. The monitoring units constructed to work with these systems must be designed so that their operation does not increase the risk that the vapors being recovered may be inadvertently ignited.

SUMMARY OF THE INVENTION

This invention relates to a vapor recovery system with an integral monitor unit wherein the monitor unit is economical to fabricate, easy to install and requires relatively little maintenance or skill to operate.

BRIEF DESCRIPTION OF THE DRAWINGS

This invention is pointed out with particularity in the claims. The above and further advantages of the invention may be better understood by referring to the following description taken in conjunction with the accompanying drawings, in which:

DETAILED DESCRIPTION

Figure 2:
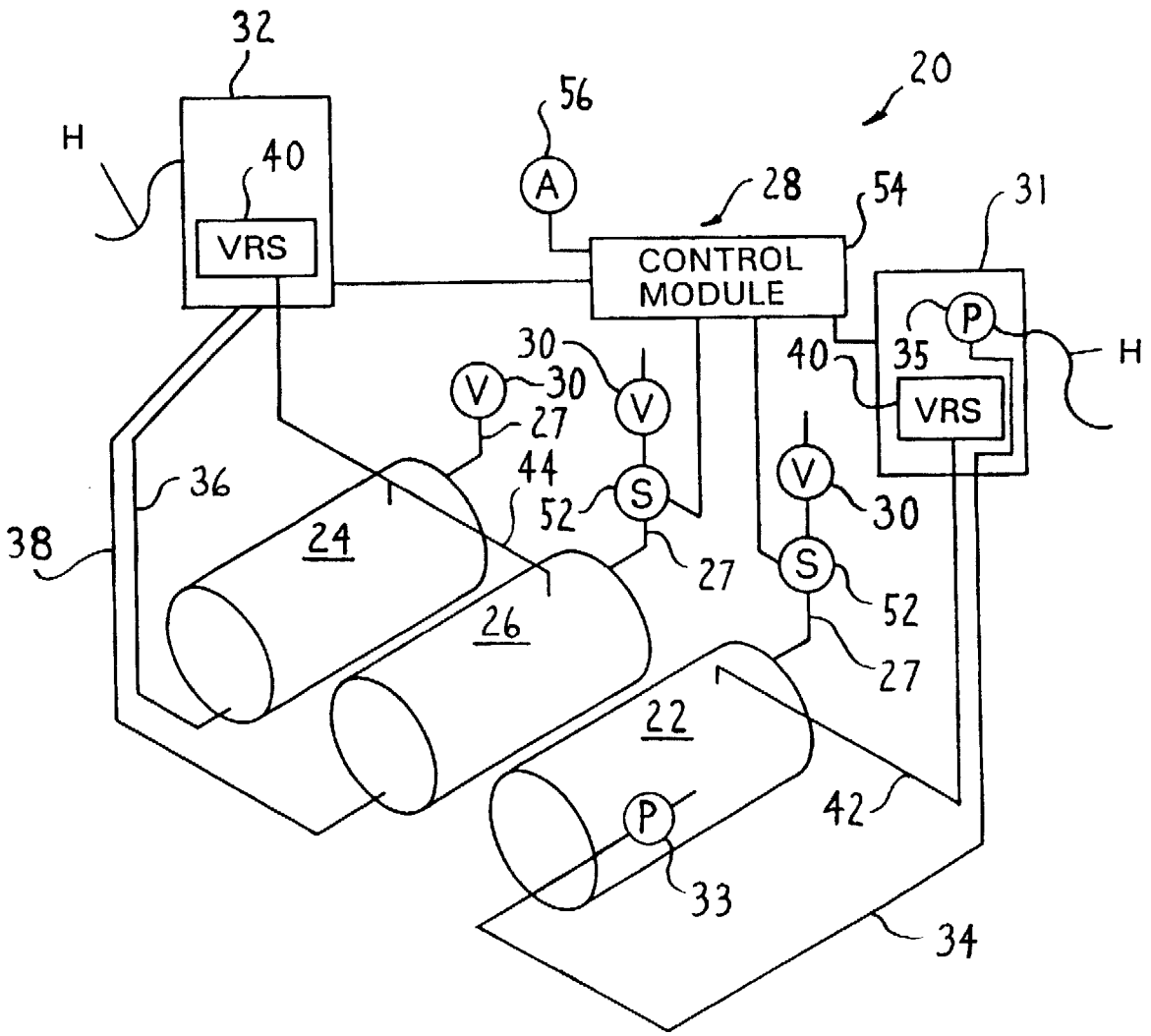
FIG. 2 is a schematic illustration of the gasoline storage tanks in which the monitoring unit of the vapor recovery system of this invention is installed.

FIG. 2 illustrates a set of underground gasoline sealed storage tanks 22, 24 and 26 to which a vapor recovery system 20 with an integral monitoring unit 28 according to this invention is attached. The underground storage tanks 22, 24 and 26 are of the type found at commercial gasoline stations. Each tank 22, 24 and 26 is used to store a different grade or type of gasoline. For example, tank 22 may be used to store leaded gasoline, tank 24 may be used to store low octane unleaded gasoline and tank 26 used to store high octane unleaded gasoline. A vent stack 27 is attached to each tank 22, 24 and 26 and extends above ground level. Attached to the top of each vent stack is a bi-directional pressure relief valve 30. In the event pressure in the associated tank 22, 24 or 26 either falls below a selected level or rises above a selected level, the associated pressure relief valve opens to allow the tank pressure to at least partially equalize to the outside pressure. In some gasoline dispensing systems the pressure relief valve is set to open when the tank pressure either falls below −8 inches $H_2O$ or exceeds 3 inches $H_2O$.

Two above ground dispensers 31 and 32 are provided for pumping the gasoline from the tanks 22, 24 and 26. Dispenser 31 is only connected to tank 22 so as to serve as the sole dispenser for the leaded gasoline. A single supply line 34 is connected between tank 22 and dispenser 31 for supplying gasoline to the dispenser. Dispenser 32 is connected to tanks 24 and 26 so as to serve as the dispenser for the unleaded gasoline. A supply line 36 is connected between tank 24 and dispenser 32 to provide the dispenser with the low octane unleaded gasoline. A supply line 38 is connected between tank 26 and dispenser 32 to provide the dispenser with the high octane unleaded gasoline.

Associated with each dispenser 31 and 32 is a set of supply pumps that draw the gasoline from the associated tank(s) 22, 24 or 26 through the dispenser and out the hose H. Typically, a submersible pump 33 (one shown) is located in the tank for pumping the gasoline through the associated supply line 34, 36 or 38. A suction pump 35, (one shown) located in the dispenser 31 or 32 forces the gasoline through the hose. Dispensers configured to dispense multiple grades of gasoline may have multiple suction pumps 35.

Figure 1:
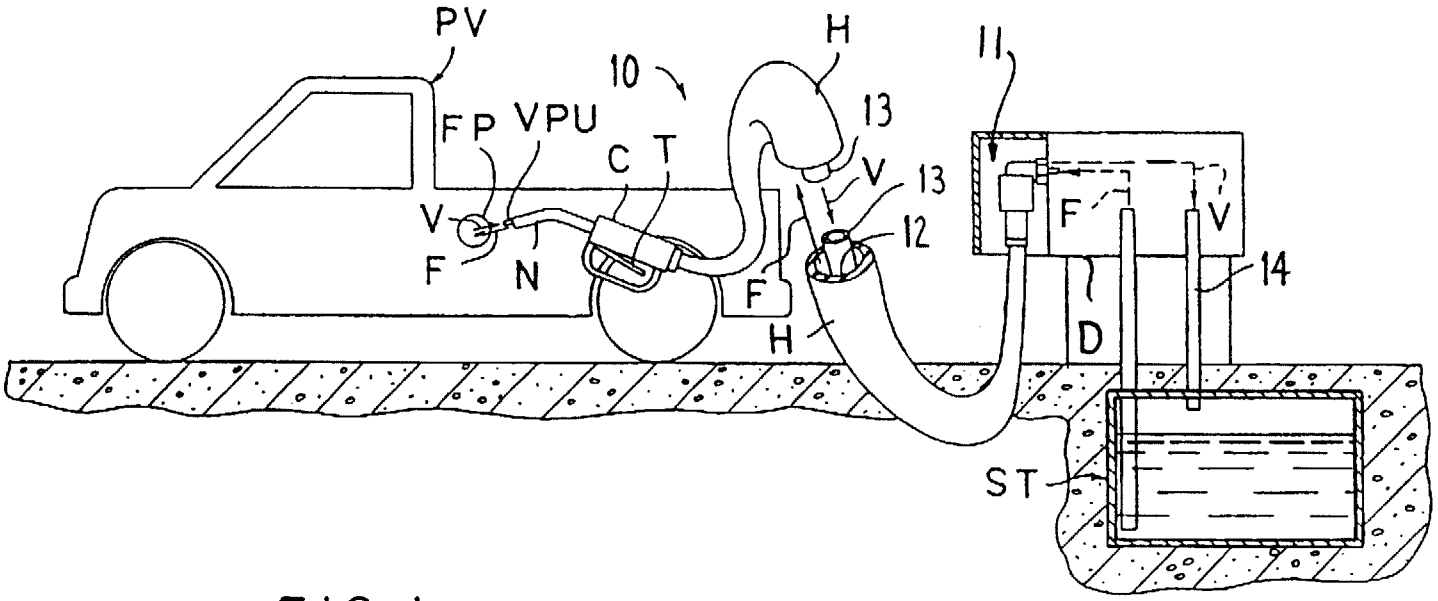
FIG. 1 is a schematic illustration of gasoline dispensers to which a vapor recovery system of this invention may be installed.

Integral with each dispenser 31 and 32 is a vapor recovery unit 40 identical in basic structure and function to the prior art vapor recovery system 10 described with respect to FIG. 1. The vapor captured by the vapor recovery assembly 40 integral with dispenser 31 is returned to tank 22 through return line 42. The vapor captured by the vapor recovery assembly integral with dispenser 32 is returned to tank 24 through a manifold 44. The manifold 44 is further connected to tank 26 to ensure that tanks 24 and 26 have approximately the same pressure. In order to facilitate the return of the vapor to the tanks 22, 24 and 26, it should be understood that the tanks are sealed and that as fuel F is withdrawn from the tanks, the pressure in the space above the fuel, referred to as the ullage initially drops.

The monitoring unit 28 of this invention includes two sensors 52 each of which monitors the operation of a separate one of the vapor recovery units 40. The sensors 52 are connected to a single control module 54 that monitors the state of the sensors. An alarm 56 is connected to the control module 54. In the event one of the sensors 52 indicates that the associated vapor recovery unit 40 is malfunctioning, the control module 54 actuates the alarm 56. In some versions of the invention, the control module 54 is also connected to the gasoline dispensers 31 and 32. In these versions of the invention, when a vapor recovery unit 40 failure is detected, the control module 54 deactivates one or both of the dispensers 31 and 32 to prevent the release of pollution-causing vapors into the environment. More particularly, the control module 54 is connected to the submersible pumps 33 and/or the suction pumps 35. When failure of a vapor recovery unit 40 is detected, the control module 54 deactivates the submersible pump(s) 33 and/or the suction pump(s) associated with the failed vapor recovery unit.

The sensors 52 are intrinsically safe, explosion proof differential pressure switches. One differential pressure switch that is believed suitable for this invention is the Series 1950 Differential Pressure Switch manufactured by Dwyer Instruments Inc. of Michigan City, Ind. Each sensor 52 is mounted in the ullage space into which the vapor from a separate one of the vapor recovery assemblies 40 is returned. One suitable ullage location for mounting a sensor 52 is in the vent stack 27 upstream from the position of the pressure relief valve 30. Still another suitable ullage location for securing a sensor 52 is in the riser tube for the dry brake that is typically provided for each tank 22, 24, and 26, (riser tube not shown). It will further be understood that a first one of the sensors is mounted to the vent stack 27 associated with tank 22, the tank disconnected from the second and third tanks 24 and 26, respectively. The second sensor 52 is mounted to the vent stack 27 associated with either tank 24 or tank 26. Only one sensor 52 is required to monitor the operation of the vapor recovery unit 40 associated with tanks 24 and 26 because manifold 44 holds these tanks at an identical pressure.

In some preferred versions of the invention, sensors 52 are normally closed differential pressure switches. These switches are set to open when the pressure in the spaces in which the sensors 52 are located falls below a select level. For example, in some preferred versions of the invention, the switches forming the sensors 52 open when a vacuum pressure of between a −3 inches to −7.5 inches of $H_2O$ is detected. In still more preferred versions of this invention, a switch forming a sensor 52 opens when the vacuum pressure drops below −6 inches of $H_2O$.

Figure 3:
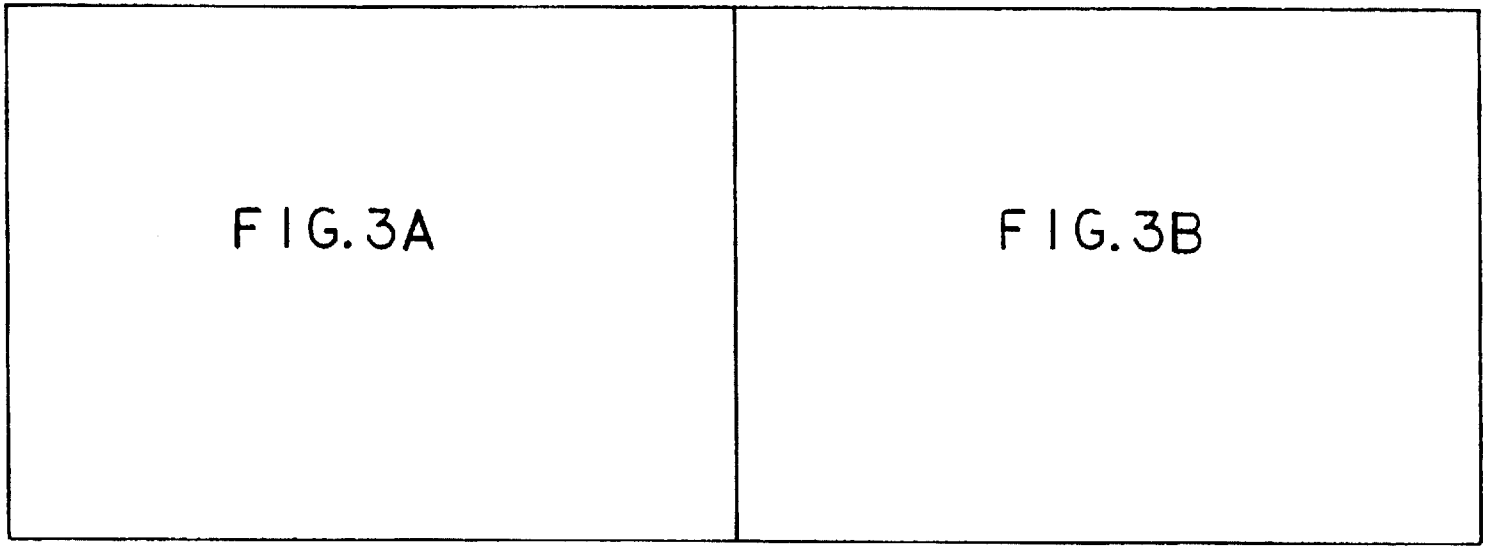
FIG. 3 is a blueprint depicting how the schematic diagrams of FIGS. 3A and 3B are assembled together to form a schematic diagram of the components of one particular monitoring assembly.
Figure 3A:
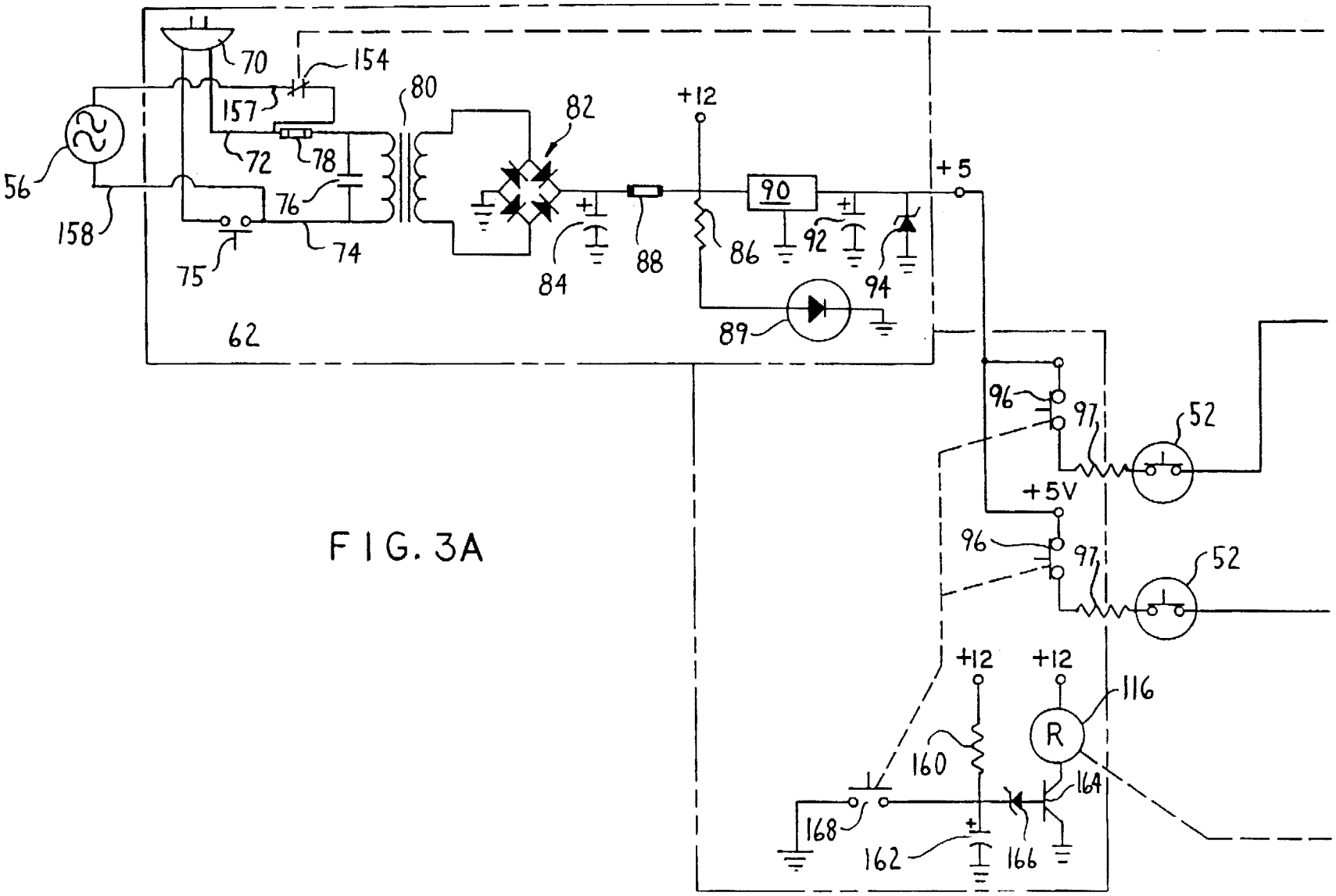
Figure 3B:
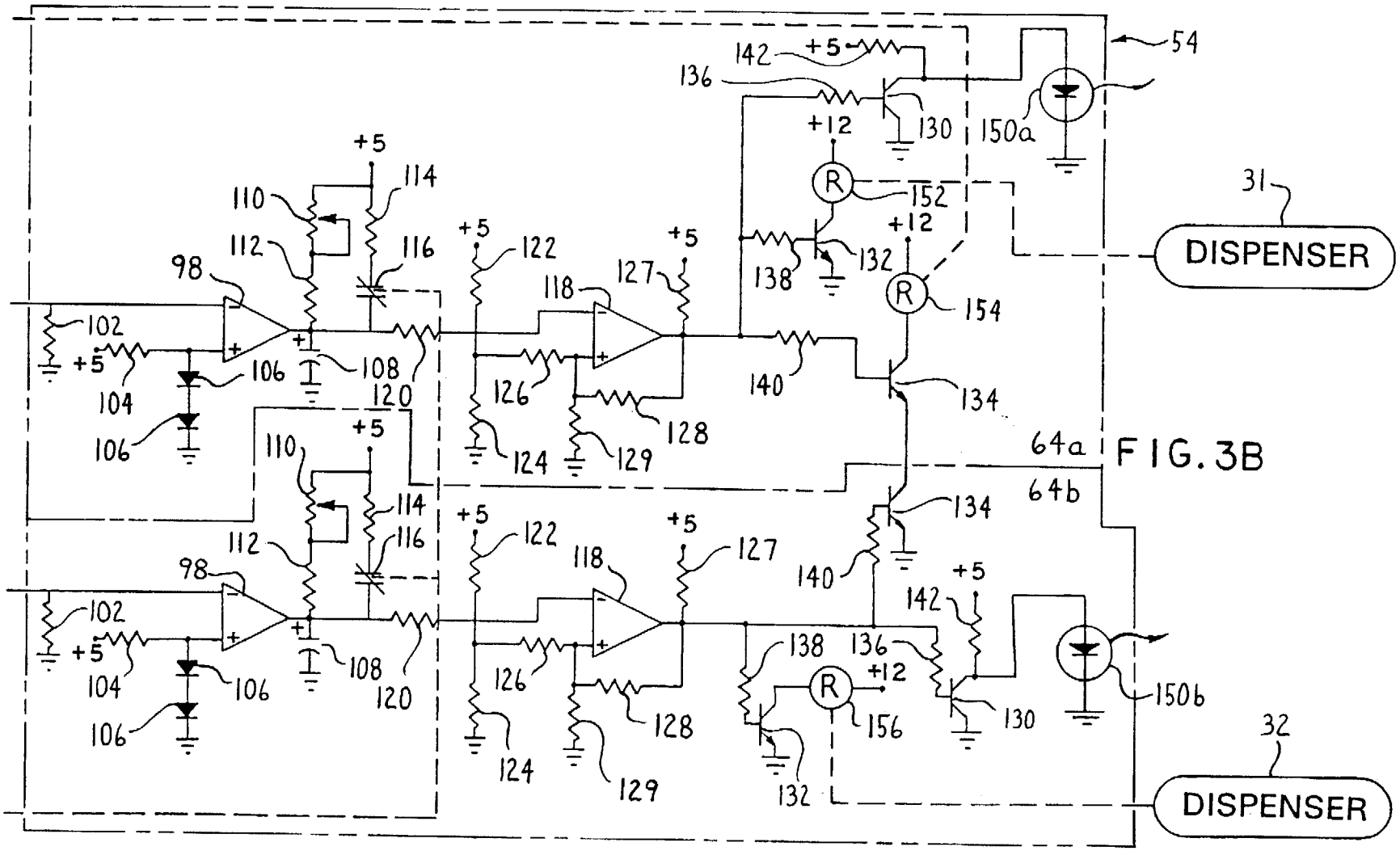

The control module 54 and operation of the monitoring unit 28 is described with reference to the schematic drawings of FIGS. 3A and 3B. The control module 54 includes a power supply circuit 62 for supplying the requisite supply voltages needed to energize the other elements of the control module. There are two sensor channels **64*a* and 64*b* each of which is designed to monitor the signal from a separate one of the sensors 52. There is also a test circuit 66 which performs an auto-test on the monitoring unit 28 when it is initially actuated and that is further configured to allow personnel to test the operation of the unit 28** at will.

The power supply circuit 62 includes a terminal plug 70 for connecting the control module 54 to an external power supply terminal, for example 120 VAC outlet. A pair of conductors 72 and 74 are connected to the opposed contacts of the terminal plug (contacts not identified). A switch 75 attached to one of the conductors, here conductor 74, is used to control the activation of the monitoring unit 28. In some versions of the invention switch 75 may be integral with a circuit breaker. A metal oxide varistor 76 is connected across conductors 72 and 74. A fast-acting fuse 78 is series connected to conductor 72 between terminal plug 70 and varistor 76. In the event an abnormal voltage spike is applied to the terminal plug 70, or the terminal plug is inadvertently connected to a power supply that provides a power signal greater than 120 VAC, the varistor 76 functions as a suppressor to prevent the signal from being applied to a downline components. In the event any voltage surge is more than a momentary spike, the fuse 78 will blow to prevent damage to any of the downline components.

Conductors 72 and 74 are connected to the opposed ends of the primary winding of a step down transformer 80. The secondary winding of transformer 80 is tied across a bridge rectifier 82. A capacitor 84 is tied between the output terminal of bridge rectifier 82 and ground to smooth out the rectified DC voltage. A current limiting resistor 86 is also tied to the output terminal of the bridge rectifier through a slow-blowing fuse 88. Resistor 86 is tied to ground through a forward biased LED 89.

In the described version of the invention, transformer 80, bridge rectifier 82, capacitor 84 and resistor 86 are selected so that a +12 VDC supply voltage is available at the output terminal of the bridge rectifier. This +12 VDC signal is then used by the other components of the control module 54, connections not depicted. Fuse 88 is a slow blow fuse. In some preferred versions of the invention fuse 88 has a maximum current rating of 375 mA.

Power supply circuit 62 also includes a DC-to-DC voltage regulator 90 to which the +12 VDC power signal is applied. Voltage regulator 90 produces a constant intrinsically safe +5 VDC signal which is supplied to the other components of the control module 54. One integrated circuit available for use as voltage regulator 90 is the 7805 manufactured by National Semiconductor. A capacitor 92 is tied between the output of the voltage regulator 90 and ground to minimize any ripple in the output signal from the voltage regulator. A suppressor diode 94 is connected in parallel across capacitor 92. The suppressor diode 94 is reverse biased so as to tie the output signal from voltage regulator 90 to ground whenever the signal exceeds a potential of approximately 6 volts. Thus, fuse 88 and diode 94 cooperate to prevent the power supply circuit from generating power supply signals that can either damage components or present an explosion risk in certain environments in which the monitoring assembly 28 is employed.

Each sensor channel **64*a* and 64*b* monitors the vacuum measured by a separate one of the sensors 52. Accordingly, only a single one of the channels, channel 64*a*, will be described in detail. As seen in FIG. 3A the sensor 52 is represented as a normally closed switch. A 5 VDC signal is applied to the one end of the sensor 52 from the power supply 62 through a normally closed switch 96 that is part of the test circuit 66. A current limiting resistor 97 is connected in series between switch 96 and the sensor 52. The opposed end of the sensor 52 is applied to the first sensor channel 64*a* and more particularly to the inverting input of a first stage comparator 98. A pull-down resistor 102 is connected between the inverting input of comparator 98 and ground to ensure that a signal voltage is presented to comparator 98. In the described version of the invention, comparator 98** has an open collector output transistor.

A reference voltage is applied to the noninverting input of comparator 98. In the illustrated version of the invention, the 5 VDC signal is applied to the noninverting input of comparator 98 through a resistor 104. Two series connected diodes 106 are connected between the noninverting input of comparator 98 and ground so as to cause a reference voltage of approximately 1.2 VDC to be presented to the comparator.

The output of comparator 98 is applied to a capacitor 108 that is tied to ground. The 5 VDC signal is also applied to capacitor 108 through a two-part resistor network. The first part of the resistor network consists of variable resistor 110 and resistor 112 which is connected in series to resistor 110. Resistor 110 is an adjustable resistor in order to facilitate the adjustment of the charging time of capacitor 108.

The second part of the resistor network consists of a resistor 114. Resistor 114 and a series connected, normally closed relay 116 are connected in parallel across resistors 110 and 112. Resistor 114 has a resistance that is substantially less than the resistance of resistor 112. In some preferred versions of the invention, resistor 114 has a resistance that is only one-four hundredth or less of the resistance of resistor 110. As will be described hereinafter, relay 116 is usually held in the energized, open switch state. Consequently, resistor 114 is normally disconnected from the resistor network.

The signal present at the output of comparator 98 is applied to the inverting input of a second stage comparator 118 through a resistor 120. A voltage divider which consists of series connected resistors 122 and 124 is used to supply a reference voltage to the noninverting input of comparator 118. The input to the voltage divider is the 5 VDC signal. The signal from the junction of resistors 122 and 124 is applied to the noninverting input of comparator 118 through a resistor 126. A positive feedback resistor 128 is connected between the output of comparator 118 and the noninverting input. A resistor 129 is tied between the noninverting input of comparator 118 and ground. The 5 VDC signal is applied to the output terminal of comparator 118 through a resistor 127. Comparator 118 and the associated components thus function as a Schmitt trigger that ensures that once the output signal from comparator 98 rises above the reference signal, the output from comparator 118 will rapidly fall.

The output signal from comparator 118 is applied to bipolar transistors 130, 132 and 134. More specifically the output signal from comparator 118 is applied to the base of transistor 130 through a resistor 136, to the base of transistor 132 through a resistor 138 and to the base of transistor 134 through a resistor 140. The emitters of transistors 130, and 132 are all tied to ground. As will be discussed hereinafter, the emitter of transistor 134 is series connected to the collector of a second transistor 134 that forms part of the second sensor channel **64*b***.

The 5 VDC signal is applied to the collector of transistor 130 through a resistor 142. An LED **150*a* is connected between the collector of transistor 144 and ground. The +12 VDC is applied to the collectors of transistors 132 and 134. More particularly, the +12 VDC signal is applied to the collector of transistor 132 through the control inputs of a normally open relay 152 so as to function as the on/off gate signal that controls the state of the relay 152. The +12 VDC signal is applied to the collector of transistor 134 through the control inputs of a normally closed relay 154 so as to serve as the on/off gate signal that controls the state of the relay 154**.

The second sensor channel **64*b* contains the same components as the above described first sensor channel. It will be noted that transistor 130 of the second sensor channel 64*b* is connected to an LED 150*b*. The +12 VDC signal is applied to the collector of transistor 132 of the second sensor channel 64*b* through the control terminals of a normally open relay 156. The collector of transistor 134 of the second sensor channel 64*a* is tied to the emitter of the first sensor channel 64*b***.

In the depicted version of the invention, the alarm 56 is represented as a piezo-electric member that is actuated by the 120 VAC line voltage. In this version of the invention, conductors 157 and 158 connect alarm 56 to conductors 72 and 74, respectively. Conductor 157 is connected to conductor 72 before the location at which fuse 78 is connected to conductor 72. Current flow to the alarm is controlled by the contact elements of relay 154 which is connected in series with separate sections of conductor 157.

The test circuit 66 as discussed above, includes two normally closed switches 96 each of which controls the application of the 5 VDC signal to a separate one of the sensors 52. Test circuit 66 further includes a series connected resistor 160 and capacitor 162 to which the +12 VDC signal is applied. The signal present at the junction of resistor 160 and capacitor 162 is applied to the base of a bipolar transistor 164 through a reverse biased zener diode 166. The emitter of transistor 164 is connected to ground. The +12 VDC signal is applied to the collector of transistor 164 through the control terminals of relay 116.

Test circuit 66 further includes a switch 168 that extends between the junction of resistor 160 and capacitor 162 and ground. Switch 168 is normally open. The switches 96 and switch 168 are operated together. The manual actuation of a single test button, (not shown) will open switches 96 and close switch 168.

The monitoring unit 28 of the vapor recovery system 20 of this invention operates by monitoring the pressure in the sealed gasoline tanks 22, 24, and 26 into which the recovered vapor is returned. When the vapor recovery units 40 are operating normally, they pump vapor-laden air into the tanks 22 or 24 and 26 from which the gasoline is simultaneously being dispensed. The discharge of air into the ullage of the tanks thus hold the pressure in the ullage at approximately atmospheric levels, approximately −1 to 1 inch of $H_2O$.

When the vapor recovery units 40 are properly functioning, the pressure differential switches that function as the sensors 52 are in the closed state. Consequently the 5 VDC signal is applied through each sensor 52 to the first stage comparator 98 of the associated sensor channel 64*a* of 64*b*. Since the signal present at the inverting input of each comparator 98 is greater than the signal present at the noninverting input, the comparator will produce a relatively low output signal. This low output signal of comparator 98 is applied to the inverting input of the second stage comparator 118. Consequently, when the vapor recovery units 40 are properly functioning, the signal present at the inverting inputs of comparator 118 will be less than the reference signal present at the noninverting inputs. Each comparator 118 will thus output a relatively high signal that turns on the associated transistors 130, 132 and 134.

The turning on of the transistors 130 forms short circuits that prevent the application of energization voltages to LEDs 150*a* and 150*b*. The turning on of the transistors 132 allows current to flow through the control terminals of relay 152 and relay 156. Thus, relays 152 and 156 are held in their close states so as to allow the control/actuation currents that flow through the relay contact elements to be applied to the associated dispenser 31 or 32 components. The turning on of transistors 134 causes the control signal to flow through the terminals of relay 154. The application of this control current opens the contact element of relay 154. The opening of relay 154 prevents the current flow through conductor 157 required to actuate the alarm 56. Thus, when the sensors 52 indicate that the vapor recovery units are properly functioning, the control module 54 allows the dispensers 31 and 32 to be energized and prevents the actuation of the alarm 56.

In the event one of the vapor recovery units 40 malfunctions, the pressure in the associated tank 22 or tanks 24 and 26 will start to fall as gasoline is dispensed from the tank(s). Once the tank pressure falls below the level to which the sensor 52 is set, the switch forming the sensor will open. The opening of this switch will cause the signal applied to the inverting input of the associated first stage comparator 98 to fall to zero. The reversal of relative signal levels at the inputs to comparator 98 will cause the output transistor of comparator 98 to turn off. This will allow capacitor 108 to be charged through resistors 110 and 112. The time period it will take to charge capacitor 108 is a function of the resistance of variable resistor 110. In some preferred versions of the invention, resistor 110 is selected so that the charging time for capacitor 108 can be set for a period of 1 to 60 minutes.

Once the voltage across capacitor 108 reaches a selected level, it will exceed the reference voltage applied to the noninverting input of comparator 118. Consequently, the output of comparator 118 will rapidly go low so as to cause the turning off of transistors 130, 132 and 134. The turning off of transistor 130 causes an energization voltage to be applied to the associated LED 150*a* or 150*b* so as to actuate the LED. The actuation of the LED 150*a* or 150*b* thus provides a visual indication of which of the two vapor recovery units 40 malfunctioned.

The turning off of transistor 132 thus stops current flow through the control terminals of the associated relay 152 or 156. Consequently, the contact elements of the relay 152 or 156 return to their normal, open, state. The opening of theses contact elements interrupts the application of an actuation signal to the associated dispenser 31 or 32 so as to deactivate the dispenser and, more particularly, the submersible pump(s) 33 and/or the suction pump(s) 35 associated with the malfunction vapor recovery unit 40. The turning off of either of the transistors 134 interrupts the current flow through the control terminals of relay 154. The contact elements of relay 154 thus return to their normal, closed, state. The closure of the contact elements of relay 154 thus allow an energization current to be applied to the alarm 56 so as to cause the actuation of the alarm. Thus, when either of the vapor recovery units 40 malfunction, the control module 54 of the monitoring unit 28 deactivates the associated dispenser 31 or 32, provides an indication of specific vapor recovery unit that malfunctioned, and generates an audio alarm to provide notice of the malfunction.

The test circuit 66 both initially tests the monitoring unit 28 upon initial actuation and is further used to test the unit 28 after actuation. At the moment the monitoring unit 28 is actuated, the moment switch 75 is closed, a zero voltage is present at the junction of resistor 160 and capacitor 162. Consequently, transistor 164 is turned off. When transistor 164 is turned off there is no current flow through the control terminals of relay 116. Thus, when the monitoring unit 28 is first actuated, the contact elements of relay 116 are in their normal, closed, state.

When relay 116 is not actuated, the primary current flow to the capacitors 108 is thus through the low-resistance resistors 114. Thus, in the event either a low/zero voltage is present at the inverting input of either first stage comparator 98, the associated capacitor 108 will quickly charge. The rapid charging of capacitor 108 will result in the turning off of transistors 130, 132 and 134. Thus, if there is open connection in the signal from either sensor 52 to the control module 54, the control module, upon actuation, will assert an alarm signal which serves as an indication of the fault.

If the sensors 52 are properly functioning, the control module 54 will not, upon actuation, assert an alarm signal. Instead, capacitor 162 will slowly charge. Once the signal across capacitor 162 exceeds the breakdown voltage for diode 166, the diode will allow a turn-on voltage to be applied therethrough to the base of transistor 164. The turning on of transistor 164 causes current to flow through the control terminals of relay 116. The actuation of relay 116 opens the contacts of the relay so as to disconnect the resistors 114 from the resistor networks associated with capacitors 108. Thus, after relay 116 is actuated, capacitors 108 will charge relatively slowly, in accordance with the settings of resistors 110.

The operational state of the monitoring unit is tested by the actuation of the test button. The depression of the test button opens switches 96 and closes switch 168. The closing of switch 168 results in the discharge of capacitor 162 and the turning off of transistor 164. The turning off of transistor 162 and the associated relay 116 results in the reconnection of resistors 114 to the networks associated with capacitors 108.

The opening of the switches 96 results in the interruption of the application of the 5 VDC signal to the sensors 52. Since the low-resistance resistors 114 are reconnected to the capacitors 108, the sensor channels 64*a* and 64*b* should then, in turn, rapidly reset the relays 152, 154, 156 so as to deactivate the dispensers and the actuation of the alarm 56 and both LEDs 150*a* and 150*b*.

The vapor recovery system 20 thus includes an integral monitoring unit 28 that continually monitors whether or not the actual vapor recovery unit 40 of the vapor recovery system 20 is properly functioning. The actual monitoring is performed by a sensor 52 that is readily mounted in the ullage space of the tank(s) into which the recovered vapors are stored. This eliminates that need to have to make room for a sensor in the space associated with the vapor recovery unit itself. Moreover, in a situation wherein a single vapor recovery unit 40 is employed to capture vapor and return it to multiple tanks that are manifolded together, only a single sensor 52 needs to be provided in order to monitor the operational state of the vapor recovery unit.

Still another feature of this invention is that it is only necessary to supply the sensor 52 with a relatively low voltage, low current intrinsically safe energization signal. More particularly, in the preferred version in the invention the signal applied to the sensors is at 5 volts and has a current of 2 mA or less. This signal is well below the power levels that could cause the ignition of many flammable vapors. Thus, the monitoring unit 28 of this invention is well suited for use with vapor recovery systems employed to capture flammable vapors such as petroleum products.

Figure 4:
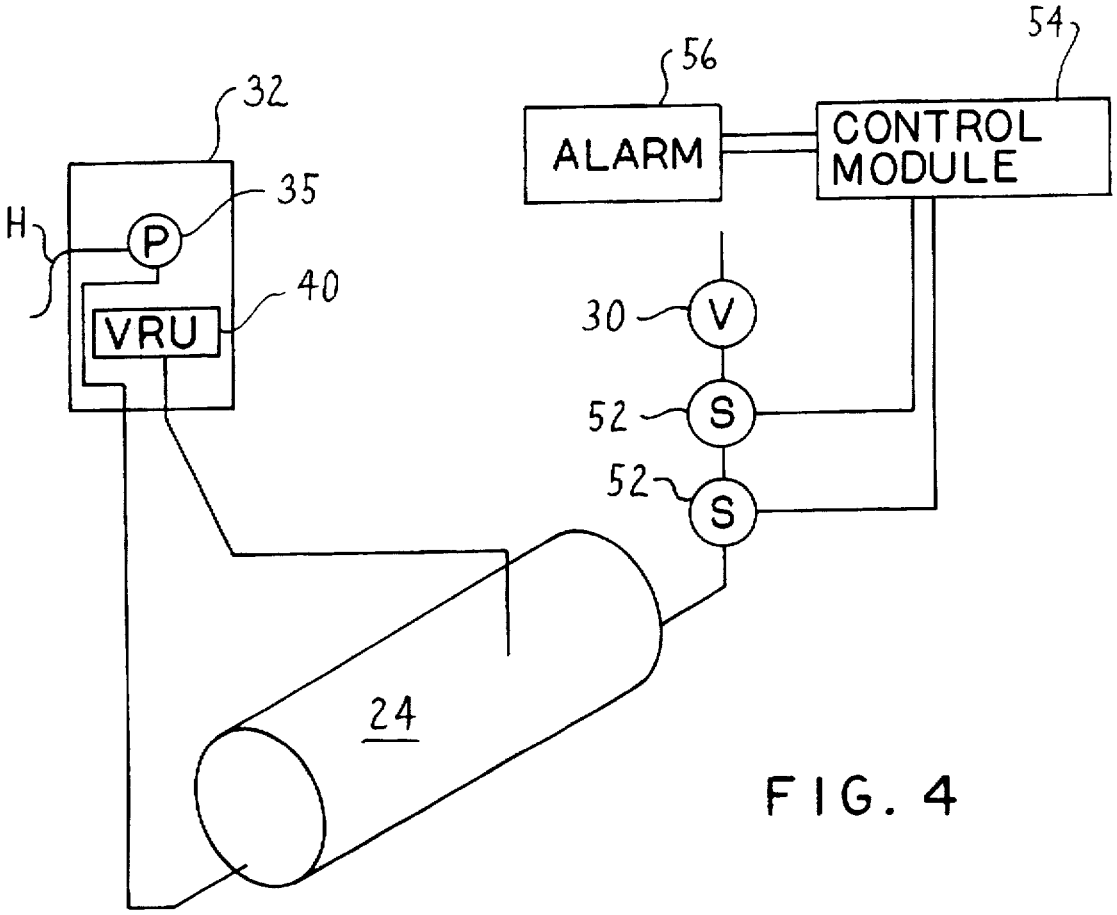
FIG. 4 is a schematic illustration of a gasoline storage tank in which an alternative monitoring unit of the vapor recovery system of this invention is installed.

Moreover, the monitoring unit 28 of this invention is provided with multiple channels 64*a* and 64*b*. Thus, the monitoring unit can be used to monitor the operation state of multiple vapor recovery units 40. Alternatively, it may be possible to reconfigure the monitoring unit so that each tank 22, 24 or 26 into which the captured vapor is returned has two or more sensors 52. In some versions of this embodiment of the invention the multiple sensors may be provided as failure redundancy feature. In other versions of the invention, as depicted by FIG. 4, the sensors 52 can be set to change signal state in response to the detection of different differential pressure levels. In these versions of the invention, the first sensor 52 could then, for example, be used to cause the generation of a warning signal of a possible vapor recovery unit 40 malfunction; the second sensor 52 would then be used to generate an alarm indicating critical failure of the vapor recovery unit.

Still another feature of this invention is that it only consists of three sub-assemblies: the sensors 52; the control module 54; and the alarm 56. Each of these units is relatively economical to manufacture and easy to install. Collectively, this makes the monitoring unit 28 as a whole easy to install. Thus, there are very few cost burdens associated with installing this monitoring unit 28, even when the unit retrofited into a preexisting vapor recovery system 20.

Moreover, the monitoring unit 28 of this invention has very few moving parts, none of which are normally exposed. Consequently the system requires little maintenance. No special skills are required to operate the monitoring unit 28.

The monitoring unit 28 of this invention is further configured so that the alarm 56 receives its energization signal from a source that is independent from the source of energization signals for the sensors 52 and the components forming the sensor channels 64*a*, 64*b*. In the event the power supply 62 fails, relay 154 will automatically return to its closed state so as to cause the actuation of the alarm 56. When this occurs, the on/off LED 89 associated with the power supply will be in the off state. Thus, collectively, the alarm 56 and LED 89 will present an indication that the monitoring unit 28 itself is malfunctioning. This feature of the invention further contributes to the ease of operation of the monitoring unit 28 of this invention by individuals with minimal training.

It should be recognized that the foregoing description of the vapor recovery system 20 with integrated monitoring unit 28 of this invention is for the purposes of illustration only. It will be apparent however, from the description of this invention that it can be practiced using alternative components other than what has been specifically described. For example, in the described version of the invention, the control module 54 is constructed out of a set of analog circuit components. It should be understood that in other versions of the invention the control module could be formed out of digital components and/or a combination of analog and digital circuit components.

Similarly, in the described version of the invention the sensor 52 is a switch that asserts a bistate signal. This should also be understood to be merely illustrative of one version of the invention. In other versions of the invention the sensor could, for example, generate an analog or digital signal that varies with the sensed pressure. In these versions of the invention, the control module could, be configured to generate a warning signal should the pressure fall below a certain level and then an alarm signal should the sensor signal drop below a second level. It should further be recognized that in some versions of the invention, the energization signal applied to the sensors may be different what has been described. In some versions of the invention, an energization signal having a potential as high as 24 volts can be applied to the sensor 52. However, in most preferred versions of the invention, the energization signal should have a voltage of 8 volts or less and a maximum current of 2 mA.

Moreover, while the system is described for use at a gasoline station, it should be recognized that it can be installed at other locations where environmental or economic reasons dictate the instillation of a vapor recovery system with an integrated monitoring unit. In these environments, the tank to which the captured vapor is returned may not be the tank from which the liquid or other material that served as the source of the vapor was withdrawn. Thus, in these versions of the invention, it may be necessary to configure the monitoring unit 28 so that the sensor 52 generates signals representative of the real-time pressure within the vapor return tank. Similarly, the control module 54 would be configured to compare the measured tank pressure to a projected tank pressure based on such factors as the volume of vapor that should have been returned to the tank. If the signal from the sensor determines that the signal from the sensor 52 indicates that the actual pressure in the tank is below the projected pressure, the control module 54 will then assert the appropriate warning or alarm signal.

Moreover, it should also be understood that the sensors 52 need not always be mounted in an ullage space already associated with the vapor recovery tank(s) 22, 24 or 26. In some versions of the invention the sensors may be placed in fluid communication with the ullage space through piping specifically provided for that purpose. In these versions of the invention as well as in other versions of the invention, flame arrestors may be fitting in the piping to further eliminate the risk that a malfunctioning associated with the sensor could cause ignition of any flammable vapors. Therefore, it is an object of the appended claims to cover all such modifications and variations that come within the true spirit and scope of this invention.

The embodiments of the invention in which an exclusive property or privilege is claimed are defined as follows:

1. A vapor recovery system for capturing vapor, said system including:

a vapor recovery unit having a conduit which is in fluid communication with a vapor pick-up port, a pump connected to said conduit for drawing vapor through the conduit, and a return line connected to said pump for receiving the vapor drawn through said pump;

a sealed return tank connected to said return line of said vapor recovery unit for receiving the vapor drawn by said pump of said vapor recovery unit; and a monitoring unit, said monitoring unit including:

a pressure sensor disposed in said return tank for monitoring pressure in said return tank and configured to generate a sensor signal representative of the pressure;

a control module connected to said pressure sensor for receiving said sensor signal, said control module being configured to compare said sensor signal to a reference signal, and, if said sensor signal maintains a selected signal state relative to said reference signal for a delay period, to selectively assert an alarm signal; and an alarm connected to said control module for receiving said alarm signal, said alarm being configured to generate a detectable alarm when said alarm signal is asserted.

2. The vapor recovery system of claim 1, wherein:

said sensor of said monitoring unit is configured to receive an energization signal;

said control module of said monitoring unit has a power supply, said power supply having a connecting member configured for connection to an external power source for receiving an external power signal, and a power convertor circuit connected to receive the external power signal from said connecting member and configured to produce said energization signal for said sensor therefrom, and said power converter circuit has a safety switch that deactivates said power converter circuit when said power converter circuit malfunctions and an indicator that is actuated by said power converter circuit when said power converter is an active state; and said alarm of said monitoring unit is connected to said connecting member of said power supply of said control module for receiving an energization signal therefrom and said alarm includes a relay that controls actuation of said alarm in response to said alarm signal, wherein said relay of said alarm is actuated by said alarm signal from said control module and is further configured to actuate said alarm when said power converter circuit of said power supply of said control module is deactivated by said safety switch of said power converter circuit.

3. The vapor recovery system of claim 1, wherein said sensor signal is a bistate signal.

4. A monitoring unit for use with a vapor recovery system, the vapor recovery system employed to capture vapors, the vapor recovery system having a sealed return tank in which the captured vapors are stored, said monitoring unit including:

a first pressure sensor disposed in the return tank of the vapor recovery system for monitoring pressure in said return tank and configured to generate a first sensor signal representative of the pressure;

a control module connected to said pressure sensor for receiving said sensor signal, said control module being configured to compare said sensor signal to a first reference signal, and, if said first sensor signal maintains a selected signal state relative to said first reference signal for a delay period, to selectively assert a first alarm signal; and a first alarm connected to said control module for receiving said first alarm signal, said alarm being configured to generate a detectable first alarm when said alarm signal is asserted.

5. The monitoring unit of claim 4, wherein said first pressure sensor is a differential pressure sensor configured to produce a bistate sensor signal wherein the state of said sensor signal is function of the pressure in the return tank of the vapor recovery system.

6. The monitoring unit of claim 4, wherein:

said first pressure sensor causes said first sensor signal to undergo a signal state transition when the pressure in the return tank undergoes a transition at a first pressure level;

said monitoring unit includes a second pressure sensor in the return tank for monitoring pressure in the return tank that is configured to generate a second sensor signal, said second pressure sensor being set to cause said second sensor signal to undergo a state transition when the pressure in the return tank undergoes a transition at a second pressure level, the second pressure level being different from the first pressure level;

said monitoring unit further includes a second alarm responsive to a second alarm signal; and said control module is configured to compare said second sensor signal to a second reference signal and, if said second sensor signal maintains a selected signal level relative to said second reference signal for a delay period, to assert said second alarm signal to said second alarm.

7. The monitoring unit of claim 6, wherein the first pressure sensor is configured to cause the first sensor signal to undergo a signal state transition when the pressure in the return tank drops below a first vacuum pressure.

8. The monitoring unit of claim 7, wherein the second pressure sensor is configured to cause the second sensor signal to undergo a state transition when the pressure in the return tank drops below a second vacuum pressure, the second vacuum pressure being different than the first vacuum pressure.

9. A dispensing system for volatile, flammable liquids, said system including:

a first sealed storage tank for holding a liquid to be dispensed;

a first dispenser connected to said first storage tank for controlling the dispensing of the liquid, said first dispenser having a dispensing conduit with a nozzle through which the liquid is dispensed;

a first vapor recovery unit including:

a return conduit located adjacent said dispensing conduit of said first dispenser, said return conduit having a vapor pick-up port located adjacent said nozzle of said dispensing conduit;

a pump connected to said return conduit for drawing vapor through said vapor pick-up port and said return conduit; and a return line connected between said pump and said first storage tank, said return line serving as conduit through which the vapor drawn by the pump is returned to said first storage tank; and a monitoring unit, said monitoring unit including:

a pressure sensor disposed in said first storage tank for monitoring pressure in said first storage tank and configured to generate a first sensor signal representative of the vapor pressure;

a control module connected to said pressure sensor for receiving said first sensor signal, said control module being configured to compare said first sensor signal to a first reference signal, and, if said first sensor signal maintains a selected signal state relative to said first reference signal for a first delay period, to selectively assert an alarm signal; and an alarm connected to said control module for receiving said alarm signal, said alarm being configured to generate a detectable alarm when said alarm signal is asserted.

10. The dispensing system of claim 9, further including a second sealed storage tank for storing liquid and wherein said return line of said vapor return unit is a manifold for returning vapor to both said first storage tank and said second storage tank and wherein said first sensor is configured to monitor the pressure of both said first storage tank and said second storage tank.

11. The dispensing system of claim 9, wherein said control module is connected to said first dispenser for controlling actuation of said first dispenser and, if said first sensor signal maintains the selected signal state relative to said first reference signal for the first delay period, said control module prevents actuation of said first dispenser.

12. The dispensing system of claim 11, wherein said first dispenser has at least one supply pump associated therewith for pumping liquid from said first storage tank and said control module is configured to prevent actuation of said at least one supply pump associated with said first dispenser in order to prevent actuation of said first dispenser.

13. The dispensing system of claim 12, wherein said at least one supply pump is a submersible pump located in said first storage tank.

14. The dispensing system of claim 9 further including: a second sealed storage tank for liquid; a second dispenser connected to said second storage tank for controlling the dispensing of the liquid from said second storage tank; and a second vapor recovery unit for drawing vapor discharged by said second dispenser, said second vapor recovery unit having a return line connected to said second storage tank through which the drawn vapor is returned to said second storage tank, and wherein said monitoring unit further includes a second pressure sensor disposed in second storage tank for monitoring the pressure of said second storage tank, said second pressure sensor being configured to produce a second sensor signal representative of the pressure in said second storage tank, and said control module of said monitoring unit is connected to said second pressure sensor for receiving said second sensor signal and is further configured to compare said second sensor signal to a second reference signal, and, if said second sensor signal maintains the selected signal state relative to said second reference signal for a second delay period, to selectively assert said alarm signal.

15. The dispensing system of claim 14, wherein said control module is connected to said first dispenser and said second dispenser for controlling actuation of said dispensers and is configured so that, if said first sensor signal maintains the selected signal state relative to said first reference signal for the first delay period, said control module prevents actuation of said first dispenser; and, if said second sensor signal maintains the selected signal state relative to said second reference signal for the second delay period, said control module prevents actuation of said second dispenser.

16. A monitoring system for use with a vapor recovery system employed to capture vapors, the vapor recovery system having a sealed return tank in which the captured vapors are stored, said monitoring system including:

a pressure sensor assembly disposed in the return tank for monitoring pressure in the return tank and generating pressure sensor signals representative of the pressure;

a control module connected to receive said pressure sensor signals and configured to monitor the pressure of the return tank based on said pressure sensor signals wherein, when said control module determines the pressure in the return tank is at a first level for a delay period, said control module asserts a first alarm signal and, when said control module determines the pressure in the return tank is at a second level, different from the first level, for a delay period, said control module asserts a second alarm signal; and an alarm unit connected to said control module for receiving said alarm signals, said alarm unit being configured to generate a distinct detectable alarm as a function of which one of said first or second alarm signals are asserted by said control module.

17. The monitoring system of claim 16, wherein said control module is configured to assert said first alarm signal when the pressure in the return tank goes below a first vacuum pressure for a delay period.

18. The monitoring system of claim 17, wherein said control module is configured to assert said second alarm signal when the pressure in the return tank drops below a second vacuum pressure, different from the first vacuum pressure, for a delay period.

19. The monitoring system of claim 16, wherein said pressure sensor assembly includes a single sensor for generating said pressure sensor signals wherein said pressure sensor signals vary with the pressure in the return tank sensed by said sensor.

20. The monitoring system of claim 16, wherein said pressure sensor assembly includes at least two pressure sensor units, each said pressure sensor unit generating a distinct signal that undergoes a signal state transition as a function of the pressure in the return tank, wherein said at least two pressure sensors units each cause said signal associated therewith to undergo a state transition as a function of a distinct pressure in the return tank.

21. A monitoring unit for use with a vapor recovery system, the vapor recovery system employed to capture vapors, the vapor recovery system having a sealed return tank in which the captured vapors are stored, said monitoring unit including:

a pressure sensor disposed in the return tank of the vapor recovery system for monitoring pressure in said return tank and configured to generate a sensor signal representative of the pressure, wherein an energization signal is applied to said pressure sensor;

a control module connected to said pressure sensor for receiving said sensor signal, said control module being configured to compare said sensor signal to a reference signal, and based on said comparison, to selectively assert an alarm signal, said control module including a power supply, said power supply having a connecting member configured for connection to an external power source for receiving an external power signal, and a power convertor circuit connected to receive the external power signal from said connecting member and configured to produce said energization signal for said pressure sensor therefrom, and said power converter circuit has a safety switch that deactivates said power converter circuit when said power converter circuit malfunctions and an indicator that is actuated by said power converter circuit when said power converter is an active state; and an alarm connected to said control module for receiving said alarm signal, said alarm being configured to generate a detectable alarm when said alarm signal is asserted and said alarm also being connected to said connecting member of said power supply for receiving an energization signal therefrom and said alarm includes a relay that controls actuation of said alarm in response to said alarm signal, wherein said relay of said alarm is actuated by said alarm signal and is further configured to actuate said alarm when said power converter circuit of said power supply is deactivated by said safety switch.

22. The monitoring unit of claim 21, wherein said safety switch of said power converter circuit of said control module is configured to selectively deactivate said power converter circuit when said power converter circuit produces a signal having a current exceeding a predefined rating.

23. A vapor recovery system for capturing vapor, said system including:

a vapor recovery unit having a conduit which is in fluid communication with a vapor pick-up port, a pump connected to said conduit for drawing vapor through the conduit, and a return line connected to said pump for receiving the vapor drawn through said pump;

a sealed return tank connected to said return line of said vapor recovery unit for receiving the vapor drawn by said pump of said vapor recovery unit; and a monitoring unit, said monitoring unit including:

a pressure sensor disposed in said return tank for monitoring pressure in said return tank and configured to generate a sensor signal representative of the pressure;

a control module connected to said pressure sensor for receiving said sensor signal, said control module including: a first stage comparator for comparing said sensor signal to a first reference signal; a time-adjustable charging circuit for receiving an output signal from said first stage comparator, wherein said output signal from said first stage comparator charges said charging circuit; and a second stage comparator for comparing an output signal from said charging circuit to a second reference signal, wherein, based on said comparison, said second stage comparator asserts an alarm signal; and an alarm connected to said control module for receiving said alarm signal, said alarm being configured to generate a detectable alarm when said alarm signal is asserted.

24. A monitoring unit for use with a vapor recovery system, the vapor recovery system employed to capture vapors, the vapor recovery system having a sealed return tank in which the captured vapors are stored, said monitoring unit including:

a pressure sensor disposed in the return tank of the vapor recovery system for monitoring pressure in said return tank and configured to generate a sensor signal representative of the pressure;

a control module connected to said pressure sensor for receiving said sensor signal, said control module including: a first stage comparator for comparing said sensor signal to a first reference signal; a time-adjustable charging circuit for receiving an output signal from said first stage comparator, wherein said output signal from said first stage comparator charges said charging circuit; and a second stage comparator for comparing an output signal from said charging circuit to a second reference signal, wherein, based on said comparison, said second stage comparator asserts an alarm signal; and an alarm connected to said control module for receiving said alarm signal, said alarm being configured to generate a detectable alarm when said alarm signal is asserted.

25. A dispensing system for volatile, flammable liquids, said system including:

a sealed storage tank for holding a liquid to be dispensed;

a dispenser connected to said storage tank for controlling the dispensing of the liquid, said dispenser having a dispensing conduit with a nozzle through which the liquid is dispensed;

a vapor recovery unit including:

a return conduit located adjacent said dispensing conduit of said dispenser, said return conduit having a vapor pick-up port located adjacent said nozzle of said dispensing conduit;

a pump connected to said return conduit for drawing vapor through said vapor pick-up port and said return conduit; and a return line connected between said pump and said storage tank, said return line serving as conduit through which the vapor drawn by the pump is returned to said storage tank; and a monitoring unit, said monitoring unit including:

a pressure sensor disposed in said storage tank for monitoring pressure in said storage tank and configured to generate a sensor signal representative of the vapor pressure;

a control module connected to said pressure sensor for receiving said sensor signal, said control module being configured to compare said sensor signal to a reference signal, and based on said comparison, to selectively assert an alarm signal said control module including a power supply and configured to produce an energization signal for said pressure sensor wherein said energization signal for said pressure sensor has a voltage less than 24 volts and a current less than 2 mA; and an alarm connected to said control module for receiving said alarm signal, said alarm being configured to generate a detectable alarm when said alarm signal is asserted.

26. A dispensing system for volatile, flammable liquids, said system including:

a sealed storage tank for holding a liquid to be dispensed;

a dispenser connected to said storage tank for controlling the dispensing of the liquid, said dispenser having a dispensing conduit with a nozzle through which the liquid is dispensed;

a vapor recovery unit including:

a return conduit located adjacent said dispensing conduit of said dispenser, said return conduit having a vapor pick-up port located adjacent said nozzle of said dispensing conduit;

a pump connected to said return conduit for drawing vapor through said vapor pick-up port and said return conduit; and a return line connected between said pump and said storage tank, said return line serving as conduit through which the vapor drawn by the pump is returned to said storage tank; and a monitoring unit, said monitoring unit including:

a pressure sensor disposed in said storage tank for monitoring pressure in said storage tank and configured to generate a sensor signal representative of the vapor pressure;

a control module connected to said pressure sensor for receiving said sensor signal, said control module including: a first stage comparator for comparing said sensor signal to a reference signal; a time-adjustable charging circuit for receiving an output signal from said first stage comparator, wherein said output signal from said first stage comparator charges said charging circuit; and a second stage comparator for comparing an output signal from said charging circuit to a second reference signal, wherein, based on said comparison, said second stage comparator asserts an alarm signal; and an alarm connected to said control module for receiving said alarm signal, said alarm being configured to generate a detectable alarm when said alarm signal is asserted.

* * * * *